US009829272B2

(12) United States Patent
Brown

(10) Patent No.: US 9,829,272 B2
(45) Date of Patent: Nov. 28, 2017

(54) FOLDABLE STOCK

(71) Applicant: AMBIMJB, LLC, Baltimore, MD (US)

(72) Inventor: Michael Jay Brown, Baltimore, MD (US)

(73) Assignee: AMBIMJB, LLC, Baltimore, MD (US)

( * ) Notice: Subject to any disclaimer, the term of this patent is extended or adjusted under 35 U.S.C. 154(b) by 28 days.

(21) Appl. No.: 14/996,525

(22) Filed: Jan. 15, 2016

(65) Prior Publication Data

US 2017/0205187 A1 Jul. 20, 2017

(51) Int. Cl.

| | |
|---|---|
| ***F41C 23/00*** | (2006.01) |
| ***F41C 23/04*** | (2006.01) |
| ***F41C 23/10*** | (2006.01) |
| *F41C 23/12* | (2006.01) |

(52) U.S. Cl.

CPC ..... *F41C 23/04* (2013.01); *F41C 23/10* (2013.01); *F41C 23/12* (2013.01)

(58) Field of Classification Search

CPC ..... F41C 23/04; F41C 23/10; F41C 23/12
USPC ..... 42/73
See application file for complete search history.

(56) References Cited

U.S. PATENT DOCUMENTS 517,555 A * 4/1894 Reed ..... F41C 23/12 42/71.01
1,016,695 A * 2/1912 Kimmel ..... F41C 23/12 42/72
1,096,861 A * 5/1914 Redfield ..... F41C 23/12 42/72
1,276,572 A * 8/1918 Rogers ..... F41C 23/12 42/148
2,437,548 A * 3/1948 Patchett ..... F41A 11/04 42/72
3,256,632 A * 6/1966 Beretta ..... F41C 23/00 42/72
3,369,316 A * 2/1968 Miller ..... F41C 23/04 42/72

(Continued)

*Primary Examiner* — Michelle R Clement
(74) *Attorney, Agent, or Firm* — Wood Herron & Evans LLP

(57) ABSTRACT

Disclosed is a foldable stock for a firearm having a separate pistol grip with an open end. The stock includes a knuckle having a first portion mountable to a firearm in a fixed position and a second portion pivotally attached to the first portion and movable about a substantially laterally transverse axis relative to the first portion between an unfolded position and a downwardly folded position. A support member longitudinally extends from the second portion and a butt member is carried on the support member. The butt member is selectively longitudinally positionable on the support member relative to the knuckle between at least an extended position and a collapsed position. The butt member includes a heel surface for abutting a user's shoulder with a downwardly extending toe portion. The toe portion includes a connector configured to connectably engage the open end of the pistol grip and prevent pivotal movement of the knuckle when in the downwardly folded position with the butt member in the collapsed position. The knuckle is movable toward the unfolded position when the butt member is at least partially extended on the support member away from the collapsed position to disengage the connector from the open end of the pistol grip.

8 Claims, 8 Drawing Sheets

(56) References Cited

U.S. PATENT DOCUMENTS 3,817,148 A * 6/1974 Schirneker ..... F41A 9/64 102/439
4,271,623 A * 6/1981 Beretta ..... F41C 23/12 42/71.02
4,383,384 A * 5/1983 Fox ..... F41C 23/04 42/72
4,513,523 A * 4/1985 Gal ..... F41C 23/04 42/72
4,640,036 A * 2/1987 Gal ..... F41C 23/04 42/72
4,735,007 A * 4/1988 Gal ..... F41C 23/04 42/7
4,766,800 A * 8/1988 Miller ..... F41A 9/59 42/49.01
4,788,785 A * 12/1988 White ..... F41C 23/04 42/72
5,778,588 A * 7/1998 Allen, III ..... F41C 23/12 42/71.02
D400,954 S * 11/1998 Ealovega ..... D22/100
7,673,412 B2 * 3/2010 Griffin ..... F41C 23/04 42/71.01
7,793,453 B1 * 9/2010 Sewell, Jr. ..... F41C 23/04 42/73
7,827,721 B2 * 11/2010 Griffin ..... F41C 23/04 42/71.01
7,966,761 B1 * 6/2011 Kuczynko ..... F41A 3/84 42/73
8,312,661 B2 * 11/2012 Ludlow ..... F41C 23/04 42/73
8,429,843 B2 * 4/2013 Yan ..... F41C 23/12 42/71.01
8,464,458 B2 * 6/2013 Chvala ..... F41C 23/04 42/73
8,631,601 B2 * 1/2014 Langevin ..... F41C 23/04 42/73
8,769,855 B2 * 7/2014 Law ..... F41C 23/14 42/73
8,776,421 B1 * 7/2014 Vesligaj ..... F41C 23/04 42/71.02
D712,998 S * 9/2014 Gomez ..... D22/108
8,819,981 B2 * 9/2014 Malik ..... F41C 23/04 42/72
8,910,407 B2 * 12/2014 Singh ..... F41C 23/06 42/71.02
9,146,075 B2 * 9/2015 Malik ..... F41C 23/04
9,441,909 B2 * 9/2016 Malik ..... F41C 23/04
2006/0254111 A1 * 11/2006 Giauque ..... F41C 23/14 42/72
2009/0277066 A1 * 11/2009 Burt ..... F41A 3/66 42/6
2012/0137562 A1 * 6/2012 Langevin ..... F41C 23/04 42/75.03
2013/0036645 A1 * 2/2013 Chvala ..... F41C 23/04 42/73
2015/0013203 A1 * 1/2015 Lopiccolo ..... F41C 23/04 42/73
2015/0316346 A1 * 11/2015 Brandt ..... F41C 23/12 42/71.02
2016/0116250 A1 * 4/2016 Mather ..... F41A 3/66 42/73

* cited by examiner

FOLDABLE STOCK

FIELD OF THE INVENTION

This invention relates to a butt stock for a shoulder-fired firearm, such as a rifle or shotgun. More particularly, it relates to a butt stock assembly that is adjustable in length and that is foldable downwardly toward a pistol grip to make the overall size and length of the firearm more compact.

BACKGROUND OF THE INVENTION

A wide variety of collapsible and/or folding stocks are known for shoulder-fired firearms, such as rifles and shotguns. Most rifles, especially those having an AR-pattern receiver, with a folding butt stock are hinged to fold to one side or the other of the receiver. The position of the folded butt stock, however, can interfere with operation of the firearm while folded, such as access to user controls or blocking an ejection port.

Folding stocks are useful both for compact storage of a firearm and for reducing the overall size or length of a firearm when being carried in a confined space, such as inside a vehicle.

SUMMARY OF THE INVENTION

The present invention provides a foldable stock for a firearm having a separate pistol grip with an open end. The stock includes a knuckle having a first portion mountable to a firearm in a fixed position and a second portion pivotally attached to the first portion and movable about a substantially laterally transverse axis relative to the first portion between an unfolded position and a downwardly folded position. A support member may longitudinally extend from the second portion and a butt member may be carried on the support member. The butt member may be selectively longitudinally positionable on the support member relative to the knuckle between at least an extended position and a collapsed position. The butt member can include a heel surface for abutting a user's shoulder with a downwardly extending toe portion. The toe portion can include a connector configured to connectably engage the open end of the pistol grip and prevent pivotal movement of the knuckle when in the downwardly folded position with the butt member in the collapsed position. The knuckle can be moved toward the unfolded position when the butt member is at least partially extended on the support member away from the collapsed position to disengage the connector from the open end of the pistol grip.

According to some embodiments of the invention, the foldable stock may include a selectively releasable locking mechanism that holds the knuckle in the unfolded position. The locking mechanism may be spring biased to lock when the knuckle is moved to the unfolded position. An actuation member of the locking mechanism may be at least partially blocked from manipulation when the butt member is in the collapsed position.

Other aspects, features, benefits, and advantages of the present invention will become apparent to a person of skill in the art from the detailed description of various embodiments with reference to the accompanying drawing figures, all of which comprise part of the disclosure.

BRIEF DESCRIPTION OF THE DRAWING FIGURES

Like reference numerals are used to indicate like parts throughout the various figures of the drawing, wherein.

DETAILED DESCRIPTION OF THE INVENTION

Figure 1:
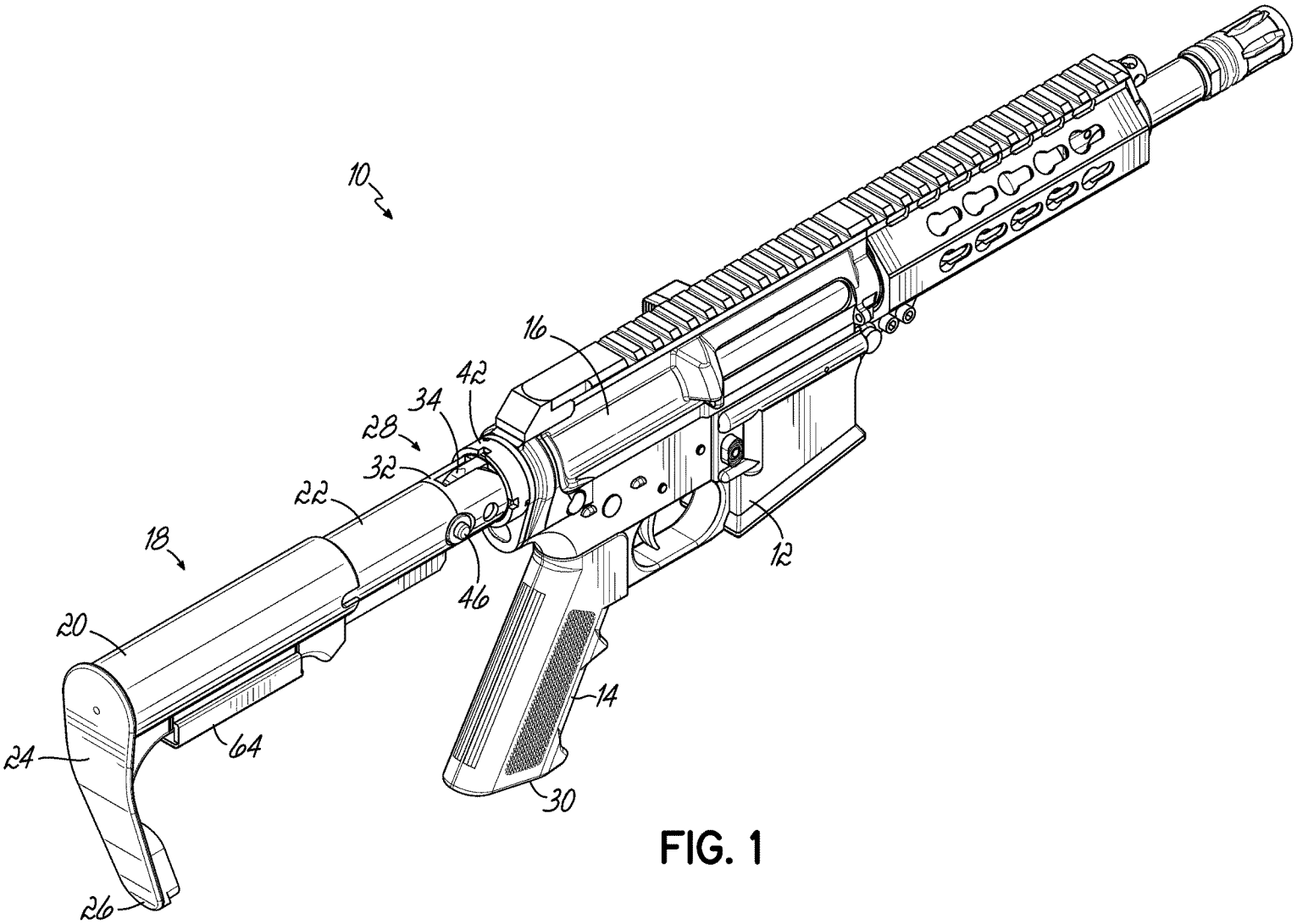
FIG. 1 is an isometric view of a rifle including a foldable stock according to an embodiment of the present invention in a fully deployed and extended position.

With reference to the drawing figures, this section describes particular embodiments and their detailed construction and operation. Throughout the specification, reference to "one embodiment," "an embodiment," or "some embodiments" means that a particular described feature, structure, or characteristic may be included in at least one embodiment. Thus appearances of the phrases "in one embodiment," "in an embodiment," or "in some embodiments" in various places throughout this specification are not necessarily all referring to the same embodiment. Furthermore, the described features, structures, and characteristics may be combined in any suitable manner in one or more embodiments. In view of the disclosure herein, those skilled in the art will recognize that the various embodiments can be practiced without one or more of the specific details or with other methods, components, materials, or the like. In some instances, well-known structures, materials, or operations are not shown or not described in detail to avoid obscuring aspects of the embodiments.

Referring first to FIGS. 1-4, therein is shown a rifle 10 having for example, an AR15-pattern lower receiver 12 and standard pistol grip 14. In the illustrated example, the upper receiver 16 is of a type in which the recoil spring and any buffer is housed within the upper receiver and cycling of the bolt/carrier does not require it to extend into a receiver extension tube. A foldable stock assembly according to one embodiment of the present invention is shown attached according to an interface standard to AR15-pattern firearms at the rear of the lower receiver 12.

Figure 2:
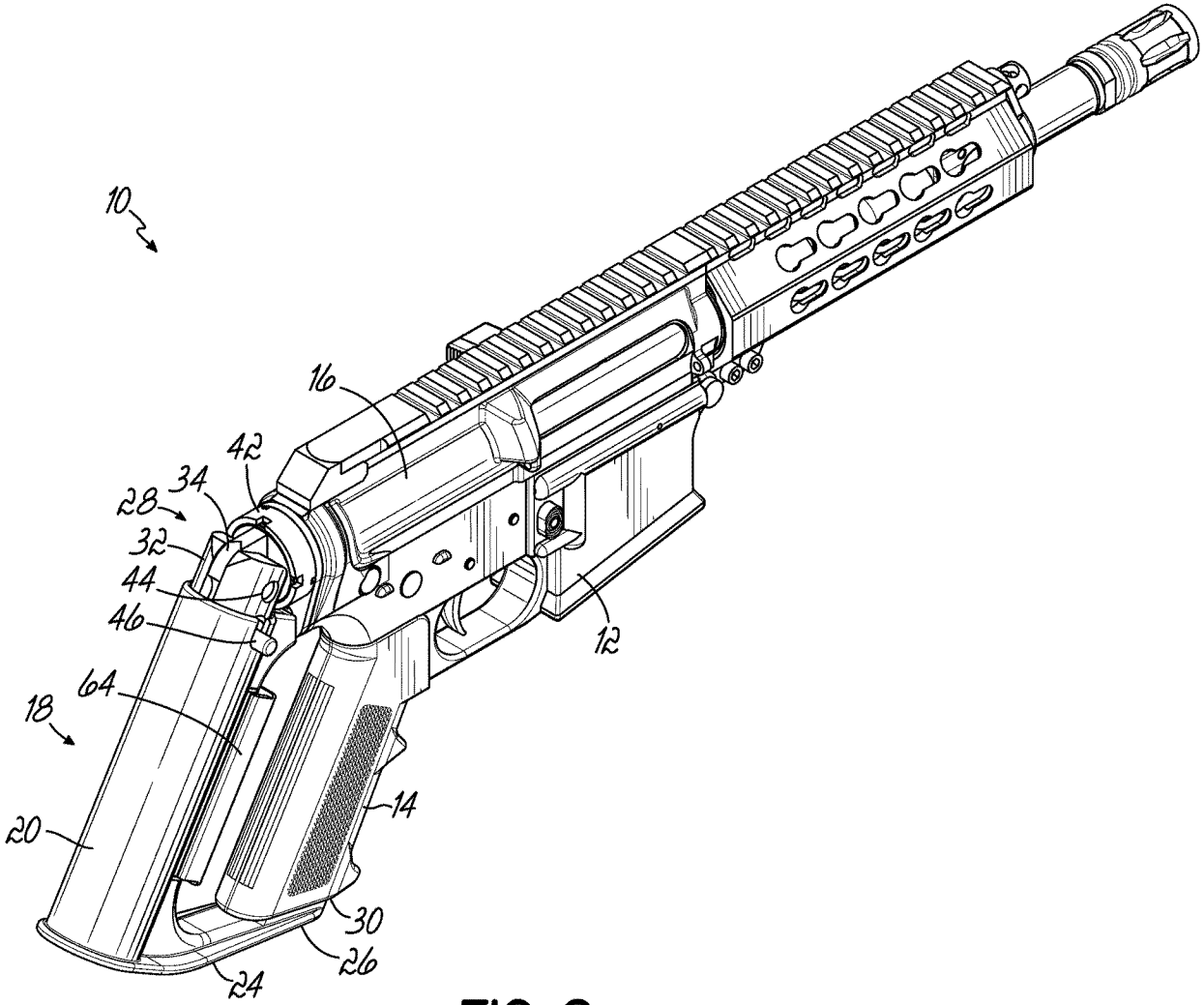
FIG. 2 is a similar view showing the stock in a collapsed and folded position.
Figure 3:
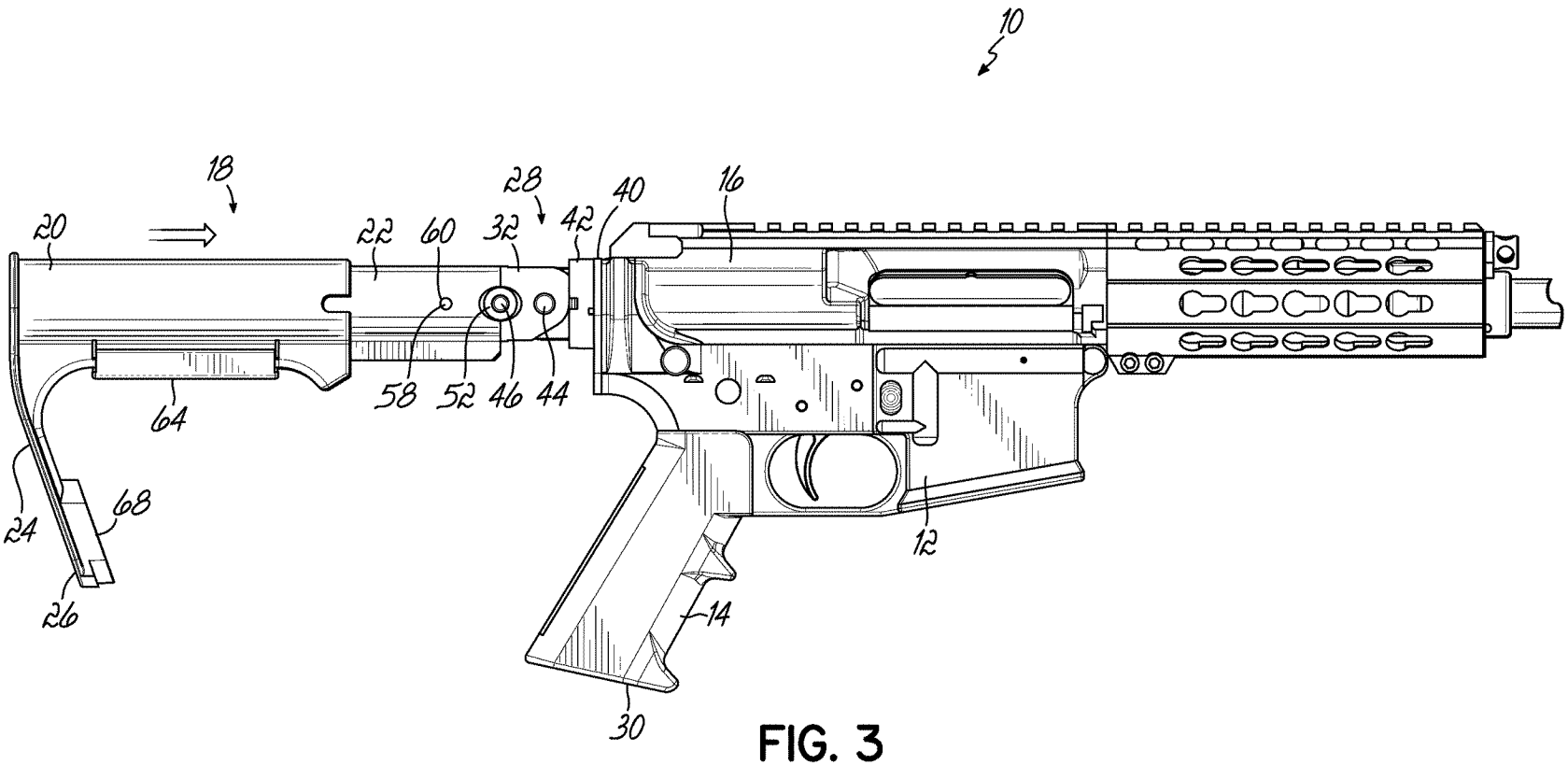
FIG. 3 is a side elevation view showing the stock in a deployed and fully extended position.
Figure 4:
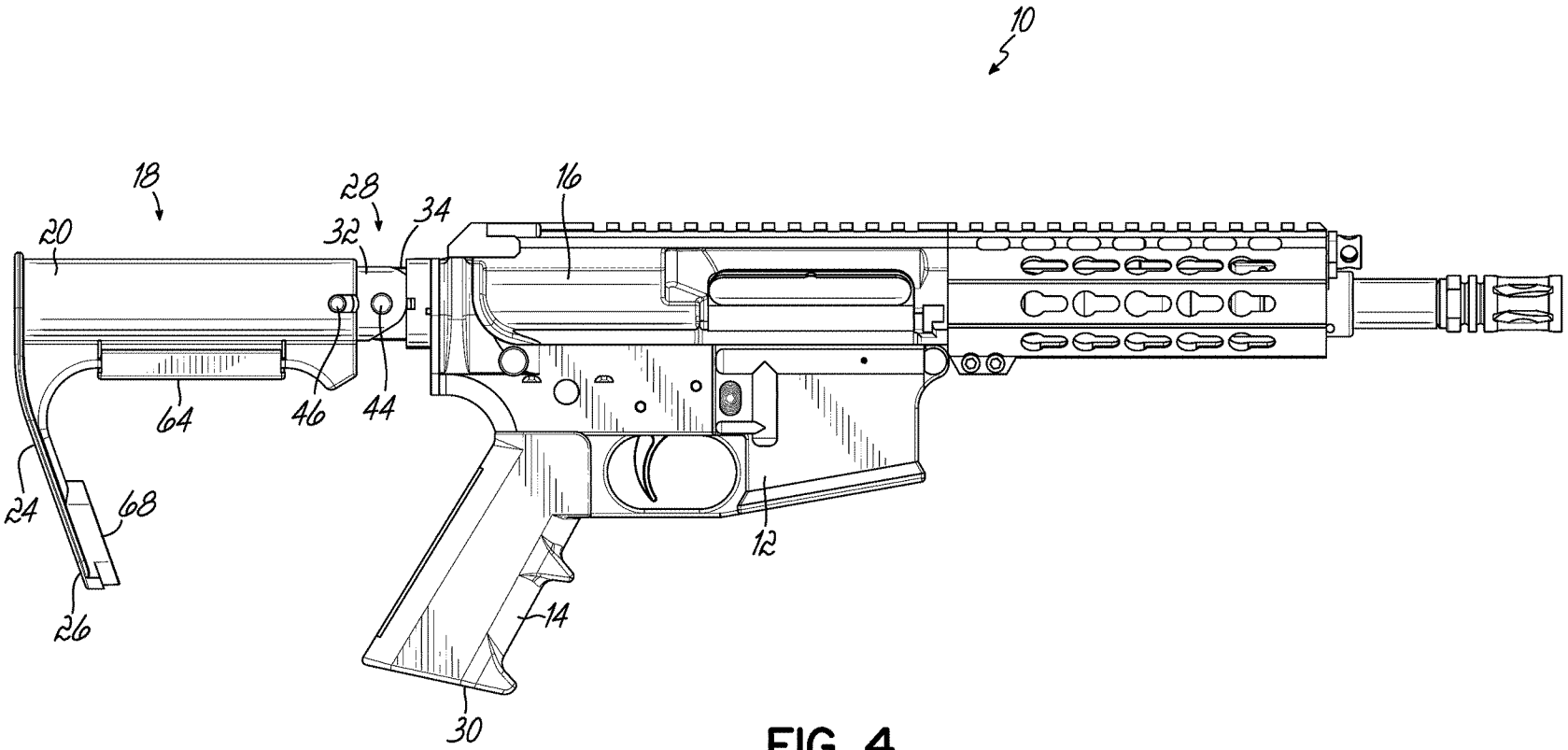
FIG. 4 is a side elevation view showing the stock in a deployed, but longitudinally collapsed, position.
Figure 5:
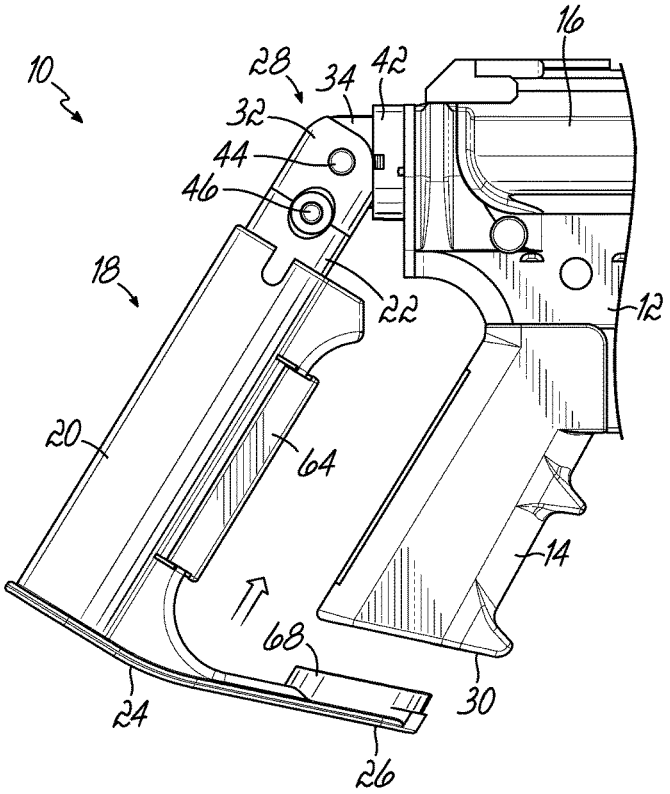
FIG. 5 is a fragmentary side elevation view showing the stock in a folded, but partially extended, position.
Figure 6:
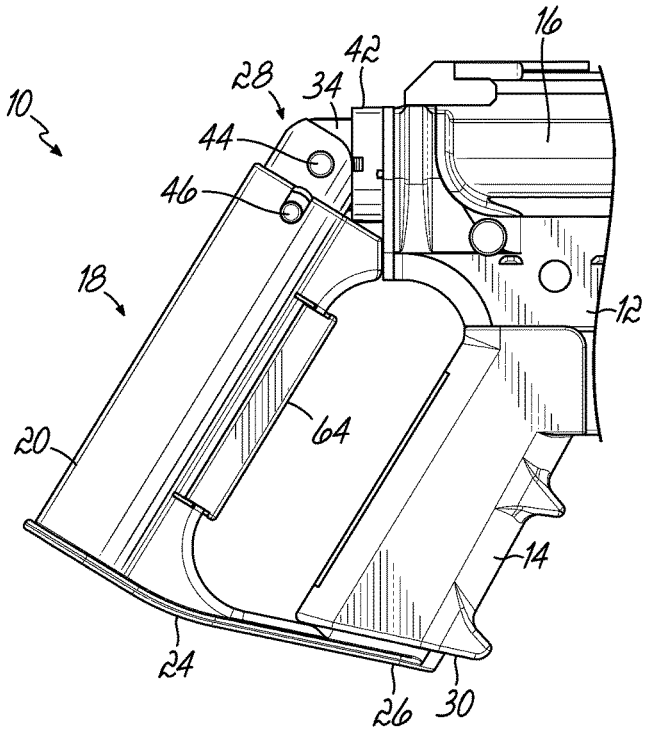
FIG. 6 is a similar view showing the stock in a folded and collapsed position in which it engages with a pistol grip.
Figure 7:
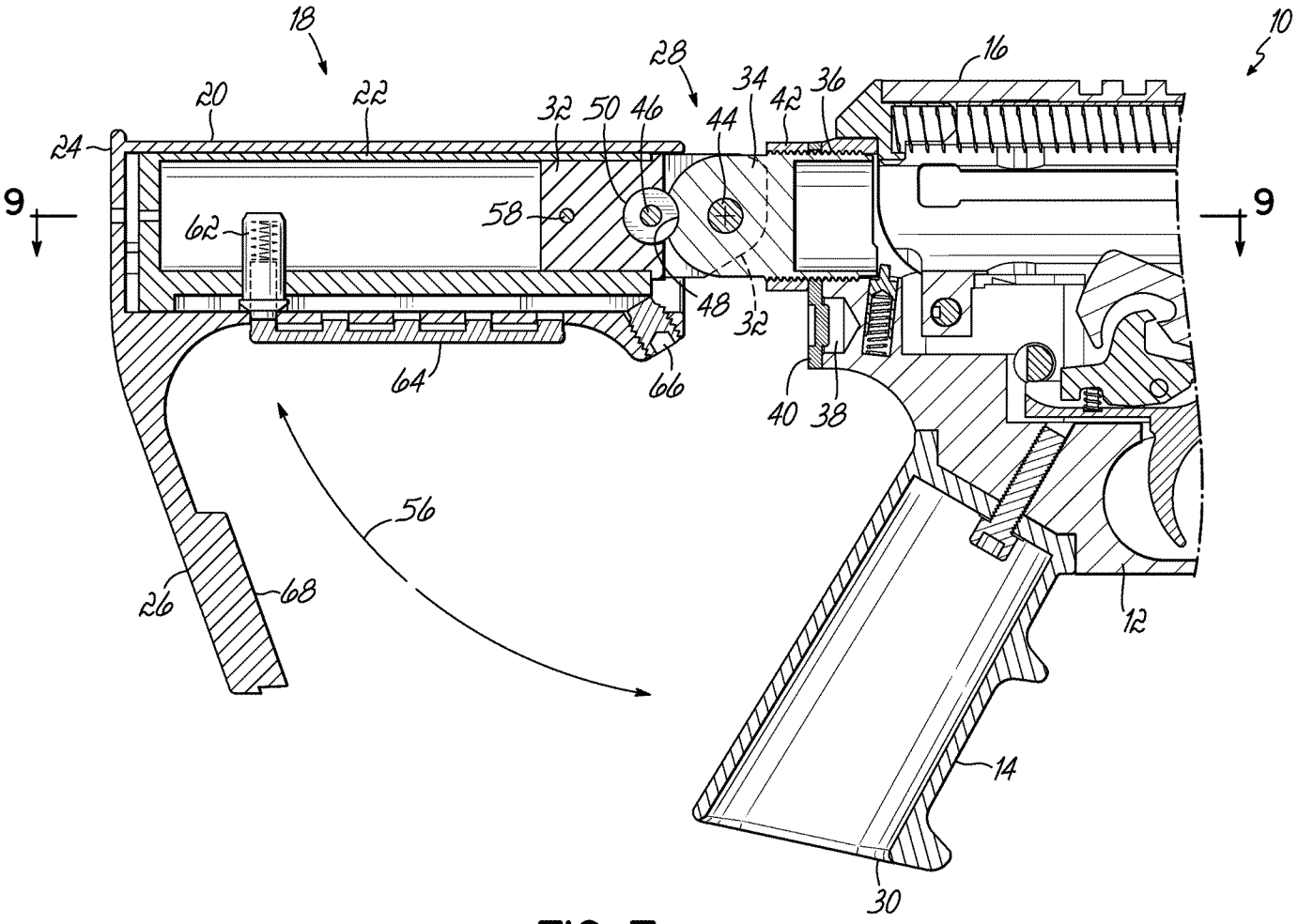
FIG. 7 is a fragmentary side sectional view showing the stock in a deployed, but collapsed, position.

In the illustrated embodiment, the stock assembly 18 includes a longitudinally repositionable butt stock 20 carried by a stock tube 22 and having a butt portion 24 with a downwardly extending toe 26. The assembly 18 also includes a knuckle 28, a forward portion of which is secured to the firearm receiver 12 and an aft extension of which may be selectively folded to a downward position (as shown in FIG. 2). As will be described later in greater detail, in an unfolded or deployed position (shown in FIGS. 1, 3, and 4), the butt stock 20 may be fully extended (FIGS. 1 and 3), fully collapsed (FIG. 4), or selectively locked at one or more intermediate positions. In this manner, the stock assembly 18 can allow an adjustable length of pull, depending on the physical characteristics of the shooter or manner in which the rifle 10 is intended to be used. As illustrated in FIGS. 2, 5, and 6, when folded, a portion of the butt stock toe 26 may engage the free end 30 of the pistol grip 14 to secure the stock assembly 18 in the folded position. This will be described in greater detail below, In the illustrated embodiment, the knuckle 28 comprises a fork portion 32 and a blade portion 34. The blade portion 34 may be mounted to a receiver 12, such as a standard AR15-pattern lower receiver, having a threaded socket 36 and offset detent opening 38. The blade portion 34 may be threaded into the receiver socket 36, secured against rotation by an otherwise standard end plate 40 and locked in place with a standard castle nut 42. In other embodiments, the location of the fork and blade portions 32, 34 may be reversed.

The blade portion 34 may be pivotally secured to the fork portion 32 with a knuckle pivot pin 44. The degree or extent of rotation of the fork portion 32 (and other parts mounted to it) can be limited by the forward profile shape of the forks, as illustrated, for example in FIGS. 3-8. In the illustrated embodiment, upward rotation is limited to a position in which the butt stock 20 and stock tube 22 are generally parallel with a longitudinal axis of the rifle 10. Downward rotation may be limited to an angle at which the toe portion 26 of the butt stock 20 may be aligned for engagement with the free end 30 of the pistol grip 14, as shown in FIGS. 2, 5, 6, and 8.

Figure 9:
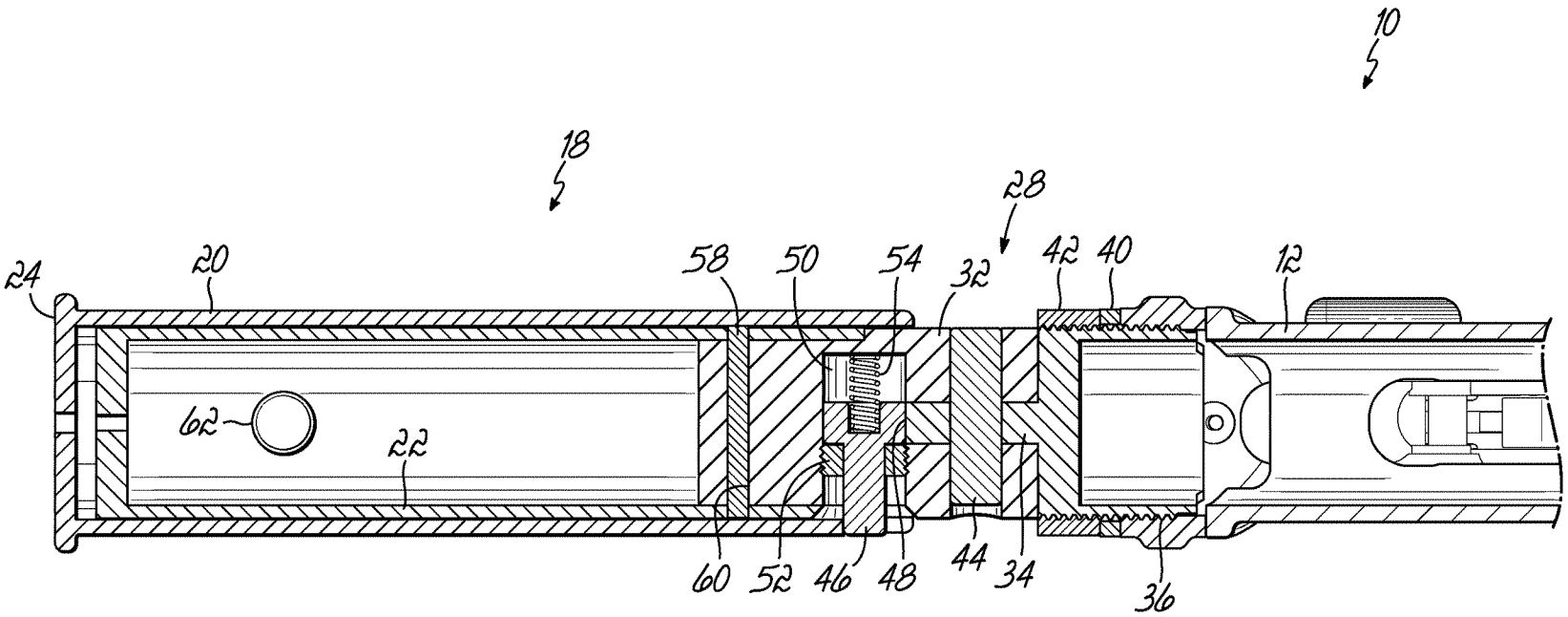
FIG. 9 is a fragmentary top sectional view taken substantially along line 9-9 of FIG. 7.

The knuckle 28 may be releasably secured against rotation at one or more position, such as by using a knuckle locking plunger 46 carried by the fork portion 32 and spring biased into engagement with one or more notch 48 on the blade portion 34. As shown in FIG. 9, the knuckle locking plunger 46 may be carried in a transverse socket 50 in the fork portion 32, retained by a locking pin retaining bushing 52, which may be threaded or otherwise engaged in the transverse socket 50, and biased toward a locking position by a knuckle locking spring 54. Displacement of the knuckle locking plunger 46 from the notch 48 allows the fork portion 32 to rotate relative to the blade portion 34. Accordingly, this allows the butt stock 20 and stock tube 22 to pivot with the blade portion 34 along an arcuate path shown by arrow 56 in FIG. 7, the knuckle pivot pin 44 acting as a pivot access. As the fork portion 32 (with the butt stock 20 and stock tube 22) are rotated to reach the deployed position (shown in FIG. 7), the knuckle locking plunger 46 will snap into locking engagement with the notch 48. Of course, the latching mechanism may be carried by the fixed or blade portion 34 of the knuckle 28.

Stock tube 20 may be integral with the fork portion 32 of the knuckle 28 or, more likely, may be a separate member fixed to the fork portion 32, such as by a telescoping joint fixed in place with an attachment pin 58 extending through a transverse bore 60. An adjustable length (or position) butt stock member 20 can be slidably carried on the stock tube 22. The longitudinal position of the butt stock 20 on the stock tube 22 may be adjustably fixed by any of several well-known mechanisms. In the illustrated embodiment, a spring-biased stock detent 62 is carried within the stock tube 22 and can be selectively engaged with any of a longitudinal series of openings provided in longitudinal alignment on the butt stock member 20. A lever bar 64 may be carried along a lower edge of the butt stock member 20, such that squeezing the lever bar 64 against the butt stock member 20 displaces the stock detent 62 and allows longitudinal adjustment until the lever bar 64 is released and the stock detent 62 engages another position on the butt stock member 20 to hold it in place. A set screw 66 may be used to limit the longitudinal movement of the butt stock member 20 relative to the stock tube 22 and may be removed to allow the butt stock member 20 to be separated from the stock tube 22.

As shown in FIGS. 5 and 6, the butt stock member 20 may be configured to at least partially obscure access to the knuckle locking plunger 46 when the butt stock member 20 is in a fully retracted position. This deters inadvertent actuation of the knuckle locking plunger 46 unless the butt stock member 22 is in an at least partially extended position.

Figure 8:
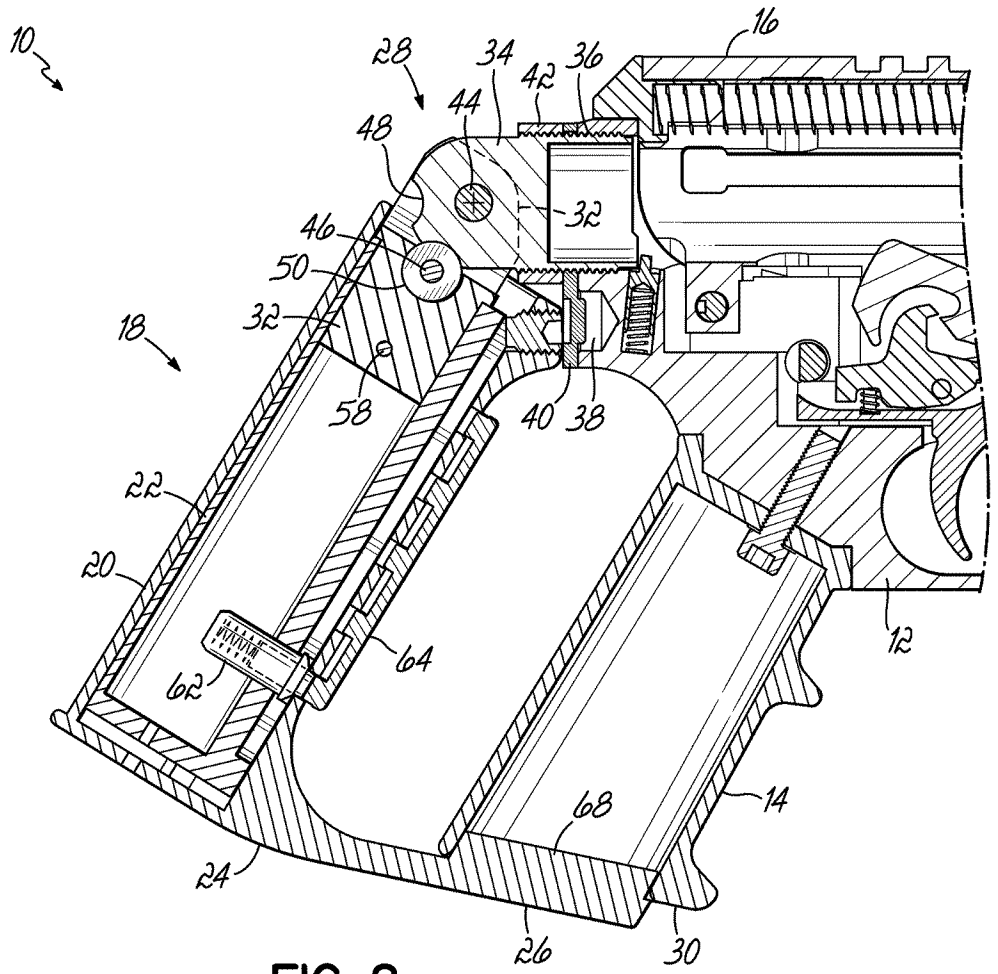
FIG. 8 is a fragmentary side sectional view similar to what is shown in FIG. 6.

As further shown by reference to FIGS. 5-8, a forward face of the butt portion 24 may include a protrusion 68, at or adjacent to the toe 26, that is shaped to be received by the open free end 30 of the pistol grip 14 when the butt stock assembly 18 is in a folded and fully retracted position. With the butt stock member 20 in an at least partially extended position, the knuckle locking plunger 46 may be depressed, allowing the knuckle 28 to fold. At its fully folded position (FIG. 5), the lever bar 64 may be squeezed to allow the butt stock member 20 to be slid toward the knuckle, engaging the protrusion 68 with the open free end 30 of the pistol grip 14, as shown in FIGS. 6 and 8. In this position, the butt stock member 20 is fully retracted and may be locked against axial movement by the stock detent 62. It is also locked against unfolding rotation by the engagement of the protrusion 68 with the pistol grip 14. In this position, the rifle 10 remains fully functional and can be gripped with one hand to be fired in the manner of a pistol without shouldering the weapon.

In the folded position, the rifle 10 is not only shorter in overall length, but is also more compact for convenient storage in a case or for carrying inside a vehicle or other confined space for quick deployment. The stock assembly 18 may then be unfolded and deployed to a fully extended position by the operator in a single, continuous movement. Gripping the lever bar 64 frees the butt stock member 20 to be at least partially extended on the stock tube 22, allowing the protrusion 68 to disengage from the open free end 30 of the pistol grip 14. This allows unfolding rotation movement at the knuckle 28. At the same time as the knuckle 28 is being moved toward the unfolded position, continued grip on the lever bar 64 allows simultaneous full or selective extension of the butt stock member 20. When the knuckle 28 reaches its unfolded or deployed position, the knuckle locking plunger 46 may be spring biased to snap into engagement with the notch 48 on the blade portion 34, locking the knuckle 28 into the extended position. Likewise, the stock assembly 18 may be folded and stowed in a single, continuous movement with one hand by reversing these steps.

The protrusion 68 at the toe 26 of the butt stock member 20 may be shaped to interface and engage with a wide variety of standard pistol grips 14 having an open free end 30, or, if desired, a specialized interface shape may be used, requiring that a particular pistol grip 14 be mated with the folding stock assembly 18.

While one embodiment of the present invention has been described in detail, it should be apparent that modifications and variations thereto are possible, all of which fall within the true spirit and scope of the invention. Therefore, the foregoing is intended only to be illustrative of the principles of the invention. Further, since numerous modifications and changes will readily occur to those skilled in the art, it is not intended to limit the invention to the exact construction and operation shown and described. Accordingly, all suitable modifications and equivalents may be included and considered to fall within the scope of the invention, defined by the following claim or claims.

What is claimed is:

1. A foldable stock for a firearm having a separate pistol grip with an open end, comprising:

a knuckle having a first portion mountable to a firearm in a fixed position and a second portion pivotally attached to the first portion and movable about a substantially laterally transverse axis relative to the first portion between an unfolded position and a downwardly folded position;

a support member longitudinally extending from the second portion; and a butt member carried on the support member, the butt member being selectively longitudinally positionable on the support member relative to the knuckle between at least an extended position and a collapsed position, the butt member including a heel surface for abutting a user's shoulder with a downwardly extending toe portion including a connector configured for engagement with the open end of the pistol grip, wherein, when the stock is mounted on the firearm, the connector connectably engages the open end of the pistol grip, preventing pivotal movement of the knuckle when in the downwardly folded position with the butt member in the collapsed position, the knuckle being movable toward the unfolded position only when the connector is disengaged from the open end of the pistol grip by the butt member being at least partially extended on the support member away from the collapsed position.

2. The foldable stock of claim 1, further comprising a selectively releasable locking mechanism that holds the knuckle in the unfolded position.

3. The foldable stock of claim 2, wherein the locking mechanism is spring biased to lock when the knuckle is moved to the unfolded position.

4. The foldable stock of claim 2, wherein an actuation member of the locking mechanism is at least partially blocked from manipulation by the butt member when the butt member is in the collapsed position.

5. A foldable stock and pistol grip combination for a firearm, comprising:

a pistol grip having a first end attachable to a firearm and second end including a first connector feature;

a foldable stock assembly, comprising:

a knuckle having a first portion mountable to a firearm in a fixed position and a second portion pivotally attached to the first portion and movable about a substantially laterally transverse axis relative to the first portion between an unfolded position and a downwardly folded position;

a support member longitudinally extending from the second portion; and a butt member carried on the support member, the butt member being selectively longitudinally positionable on the support member relative to the knuckle between at least an extended position and a collapsed position, the butt member including a heel surface for abutting a user's shoulder with a downwardly extending toe portion, wherein the toe portion includes a second connector feature configured to connectably engage the first connector feature of the pistol grip and prevent pivotal movement of the knuckle when in the downwardly folded position with the connector features engaged with one another, the knuckle being movable toward the unfolded position by at least partially extending the butt member away from the collapsed position to disengage the connector features.

6. The foldable stock of claim 5, further comprising a selectively releasable locking mechanism that holds the knuckle in the unfolded position.

7. The foldable stock of claim 6, wherein the locking mechanism is spring biased to lock when the knuckle is moved to the unfolded position.

8. The foldable stock of claim 6, wherein an actuation member of the locking mechanism is at least partially blocked from manipulation by the butt member when the butt member is in the collapsed position.

* * * * *